US007178604B2

(12) United States Patent
Meserve et al.

(10) Patent No.: US 7,178,604 B2
(45) **Date of Patent: *Feb. 20, 2007**

(54) FIRE EXTINGUISHER WITH MEANS FOR PREVENTING FREEZING AT OUTLET

(75) Inventors: William J. Meserve, Glendora, CA (US); Brad Petersen, Glendora, CA (US)

(73) Assignee: Pacific Scientific Co., Duarte, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/107,439

(22) Filed: Apr. 15, 2005

(65) Prior Publication Data

US 2005/0178566 A1 Aug. 18, 2005

Related U.S. Application Data

(63) Continuation of application No. 09/643,172, filed on Aug. 21, 2000, now Pat. No. 6,902,009.

(51) Int. Cl.
*A62C 35/58* (2006.01)

(52) U.S. Cl. ..... 169/86; 169/78; 169/85; 169/30

(58) Field of Classification Search ..... 169/86, 169/46, 78, 83, 30
See application file for complete search history.

(56) References Cited

U.S. PATENT DOCUMENTS

| | | | | | |
|---|---|---|---|---|---|
| 87,544 | A | * | 3/1869 | Clark, Jr. | 169/78 |
| 777,131 | A | | 12/1904 | Nuhring | |
| 903,527 | A | | 11/1908 | Wilbur | |
| 1,725,775 | A | * | 8/1929 | Badger | 169/86 |
| 2,389,502 | A | | 11/1945 | Griswold et al. | |
| 4,269,905 | A | | 5/1981 | Wedlake | |
| 4,643,260 | A | * | 2/1987 | Miller | 169/46 |
| 5,038,867 | A | | 8/1991 | Hindrichs et al. | |
| 5,501,284 | A | | 3/1996 | Clodfeltter et al. | |
| 5,845,716 | A | | 12/1998 | Birk | |

FOREIGN PATENT DOCUMENTS

| | | | |
|---|---|---|---|
| DE | 03773044 | | 5/1987 |
| EP | 974633 | * | 1/2000 |
| SU | 841628 | | 6/1981 |

* cited by examiner

*Primary Examiner*—Dinh Q. Nguyen
(74) *Attorney, Agent, or Firm*—Knobbe, Martens, Olson & Bear, LLP

(57) ABSTRACT

A method and an apparatus for preventing freezing at the outlet of a fire extinguisher are disclosed. Moisture in the fire extinguisher fluid is removed by contacting the fluid in the fire extinguisher bottle with a desiccant such as molecular sieve 3A. After the fluid in the extinguisher has been in contact with the desiccant for a week, the moisture level is about 5 ppm, well below the 40 ppm which causes freezeup at the outlet. The desiccant is preferably placed inside a metal screen tube having metal wire loops extending from the sides of the mesh tube. The wire loops keep the mesh tube away from the outlet so that flow restriction will not occur. The wire loops also protect the desiccant from being damaged when the fire extinguisher is discharged and provide a handle which can be used to pull the metal screen tube out of the bottle during refurbishment.

20 Claims, 1 Drawing Sheet

FIRE EXTINGUISHER WITH MEANS FOR PREVENTING FREEZING AT OUTLET

CROSS-REFERENCE TO RELATED APPLICATION

This application is a continuation of U.S. application Ser. No. 09/643,172, filed on Aug. 21, 2000, now U.S. Pat. No. 6,902,009.

BACKGROUND OF THE INVENTION

1. Field of the Invention

The invention relates to a method and an apparatus for preventing plugging of the outlet of a fire extinguisher due to freezing of water which is dissolved in the fire extinguishing fluid.

2. Description of the Related Art

Halon 1301 is used worldwide as the fire extinguishant for engine and cargo protection in most aircraft fire extinguishers. In installations in the cargo area of the aircraft, it is normally desirable to meter the flow of Halon 1301 out of the fire extinguisher in order to keep the cargo compartment inert for long periods of time. Generally, the metering system of the fire extinguisher includes an orifice to limit the flow of the Halon 1301. After liquid Halon 1301 passes through the orifice, the Halon expands into a gas. The expansion cools the gas to approximately −60° F. If the Halon is contaminated with water, the water may freeze in the orifice, plugging the orifice and blocking the flow of the Halon 1301.

Dryers have been placed in the line leading to the orifice in the metering system, since the use of the first metered systems in about 1980. Although the in-line dryer is supposed to remove the water from the Halon 1301 as the Halon passes from the fire extinguisher bottle through the line dryer to the outlet, the line dryers may not remove the water in a single pass. The typical in-line dryer is a refrigeration device which depends on having an unlimited time to condense water out of the Halon. However, the flow of Halon from the fire extinguisher through the in-line dryer may be too rapid to allow for condensation of sufficient quantities of water from the Halon to prevent freezing at the orifice.

Another method of preventing freezing at the outlet of the fire extinguisher is to add methanol to the Halon 1301 in the fire extinguisher bottle. The methanol forms a solution with the water and lowers the freezing point of the water. Adding methanol to the fire extinguisher bottle in an amount of about 0.5% of the weight of the Halon before filling is effective in preventing freezing of the orifice. However, some airlines do not allow methanol to be added to the fire extinguisher bottles because of concerns about contaminating their limited Halon supply with methanol. Manufacture of Halon 1301 has been banned due to ozone depletion concerns. Airlines therefore depend on being able to recycle their existing supplies of Halon 1301. Contamination of the Halon 1301 with solvents such as methanol could compromise the recycling of the used Halon 1301. There is thus a need for a means of preventing freezing of water contamination in the outlet of fire extinguishers without adding contaminating solvents.

SUMMARY OF THE INVENTION

The method and apparatus of the present invention provide a means for preventing freezing at the outlet of a fire extinguisher by removing the water from the fire extinguisher fluid. The water is removed by contacting the fire extinguisher fluid with a desiccant. The apparatus according to embodiments of the invention includes a container for the desiccant. The container is perforated to allow the fire extinguisher fluid to contact the desiccant. The perforations are preferably small enough to prevent the desiccant from passing through the perforations, preventing the desiccant from being blown out of the fire extinguisher. The container also protects the desiccant from being crushed due to vibration of the fire extinguisher or discharge of the fire extinguisher.

Although presented in the context of preventing freezing at the outlet of fire extinguishers containing Halon 1301 for use in aircraft, it is to be understood that the method and the apparatus of the embodiments of the invention have broad application to a wide variety of fire extinguishers and fire extinguisher fluids. The description of aircraft fire extinguishers as the fire extinguisher and of Halon 1301 as the fire extinguisher fluid are illustrative only, and the method and apparatus of the invention are not limited to these examples.

DETAILED DESCRIPTION OF THE PREFERRED EMBODIMENT

Figure 2:
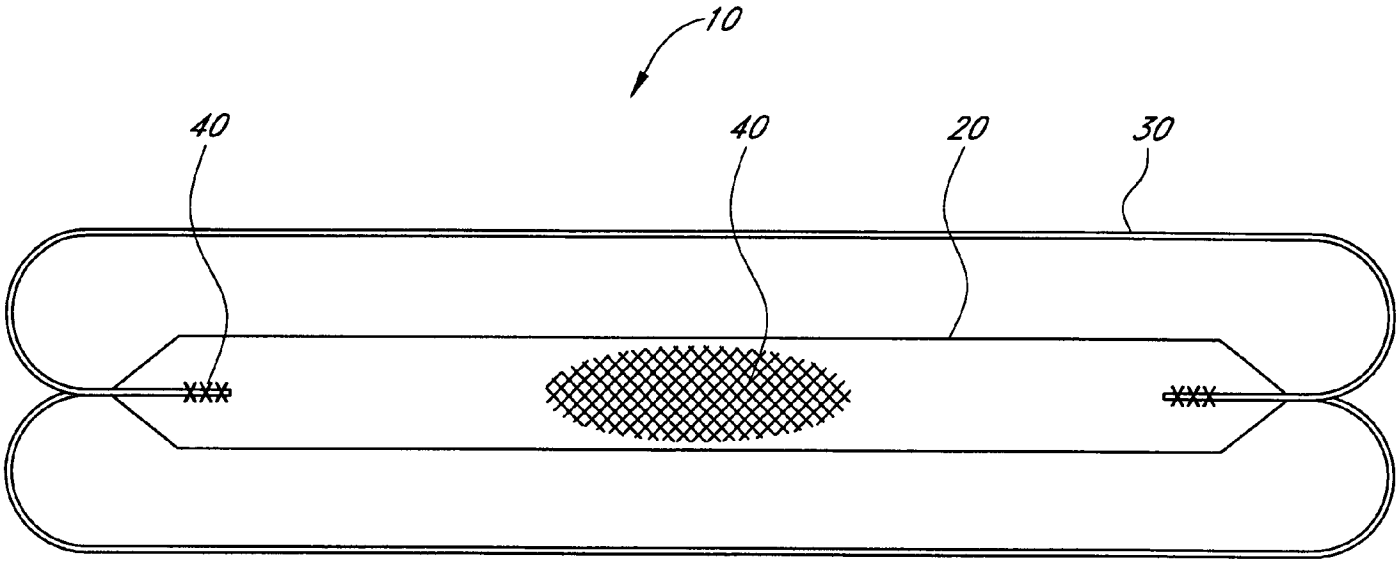
FIG. 2 is a side view of the screen tube assembly of FIG. 1.

A typical 536 cubic inch aircraft fire extinguisher holds 20 pounds of Halon 1301. Halon 1301 is bromotrifluoromethane. Halon 1301 saturates with water at a concentration of about 100 parts per million (ppm) by weight. If the Halon in a fire extinguisher containing 20 pounds of Halon 1301 is saturated with water, the Halon contains approximately 0.9 grams of water. If the fire extinguisher contains air prior to filling with Halon, the air in a standard 536 cubic inch fire extinguisher contains 0.3 grams of water vapor prior to filling, assuming 90% humidity on a 90° F. day. The maximum amount of water which can dissolve in the 20 pounds of Halon 1301 combined with the maximum expected amount of water in the air in the fire extinguisher bottle prior to filling is 0.9 grams of water in the Halon plus 0.3 grams of water in the air or 1.2 grams of water.

It has been found that drying agents or desiccants, for example, molecular sieves, are able to absorb the water from the Halon 1301, eliminating the freezing problem at the orifice of the fire extinguisher. Molecular sieves 3A and 4A, commercially available from Adcoa, are silica-alumina zeolites which are suitable for removing water from the fire extinguisher fluid.

The drying agent may be contacted with the Halon 1301 either outside the fire extinguisher or inside the fire extinguisher. Preferably, the drying agent is placed into the fire extinguisher bottle prior to filling with the Halon. Over a period of time, 2 to 5 days, the drying agent or desiccant absorbs the water contamination. The drying agent remains in the fire extinguisher until recharge is required. Because the fire extinguisher is hermetically sealed, the Halon in the fire extinguisher does not become exposed to more water until the fire extinguisher is discharged or requires recharge. Even if the Halon were to somehow be exposed to more water, excess drying agent can be placed into the fire extinguisher to absorb the additional water.

Molecular sieves have micropores which bind and hold the water within the pores of the molecular sieve. The molecular sieves have a finite capacity for absorbing water. Sufficient molecular sieve must be placed in the fire extinguisher to remove the maximum anticipated amount of water in the air in the empty fire extinguisher and the Halon 1301. Both molecular sieves 3A and 4A can absorb about 20% of their weight in water. Based on the maximum expected amount of 1.2 grams of water in a standard 536 cubic inch fire extinguisher, it is generally preferred to place at least 6 grams of molecular sieve into the fire extinguisher to remove the maximum expected amount of water from the interior of the fire extinguisher.

Contaminants in the fire extinguisher or in the Halon can compete with water for the absorption sites, reducing the amount of water that can be absorbed by the molecular sieve. For example, molecular sieve 4A absorbs both water and methanol. Any methanol contamination in the Halon 1301 would therefore reduce the amount of water that could be absorbed by the molecular sieve 4A, because the methanol competes with the water for binding sites on the 4A molecular sieve.

Molecular sieve 3A is an exemplary zeolite for removing water from the Halon 1301, because molecular sieve 3A absorbs water but not methanol. If the Halon 1301 is contaminated with methanol, the water-absorbing capacity of the molecular sieve 3A would not be reduced by the presence of the methanol, because molecular sieve 3A does not absorb methanol. The use of molecular sieve 3A is therefore generally preferred over the use of molecular sieve 4A in the embodiments of the method of the present invention. Methanol contamination would reduce the water absorption capacity of molecular sieve 4A but not the water absorption capacity of molecular sieve 3A.

In an alternative embodiment of the method of the invention, molecular sieve 4A is preferred over molecular sieve 3A in applications where it is desired to remove both water and methanol from the fire extinguisher fluid. Molecular sieve 3A is preferred in applications where it is not important to remove solvents such as methanol.

It takes several days to reduce the moisture content of the Halon 1301 from the saturation level of 100 ppm to approximately 5 ppm with molecular sieves such as 3A molecular sieve. Flow freezeup problems can occur at 40 ppm of water or higher. It is generally preferred that the Halon in the fire extinguisher be exposed to the molecular sieve for a period of at least 2 days prior to use of the fire extinguisher, more preferably at least 3 days, and most preferably at least 5 days in order to insure that sufficient water has been removed from the Halon to eliminate freezing at the orifice of the fire extinguisher. Exposing the fire extinguisher fluid to the desiccant for longer periods of time is not detrimental, because the moisture remains trapped in the desiccant.

It is preferred to place excess molecular sieve into the fire extinguisher bottle to provide a safety factor to insure that sufficient water is removed from the Halon to prevent freezing. For example, the fire extinguisher could be slightly wet before filling with Halon. For a typical 536 cubic inch fire extinguisher with 20 pounds of Halon 1301, it is generally preferred that the fire extinguisher contain about 20 grams of molecular sieve, more preferably about 25 grams of molecular sieve, and most preferably about 34 grams of molecular sieve.

Drying fire extinguisher fluids in fire extinguishers with drying agents or desiccants to minimize the possibility of freezing at the orifice can be applied to other fire extinguisher fluids besides Halon 1301. The method and the apparatus of the present invention are suitable for a wide range of fire extinguisher fluids including halocarbons and halohydrocarbons such as chlorofluorocarbons, chlorofluorohydrocarbons, fluorocarbons, fluorohydrocarbons, bromofluorocarbons, bromofluorohydrocarbons, iodofluorocarbons, iodofluorohydrocarbons, and the like. Other fire extinguisher fluids which are suitable for drying with drying agents with embodiments of the method and the apparatus of the invention include, but are not limited to, iodotrifluoromethane, HCFC-124 (chlorotetrafluoroethane), HCFC-22, HFC-236fa (1,1,1,3,3,3-hexafluoropropane), HFC-227, FC-218, FC-3110, HFC-134a, HFC-125 (pentafluoroethane), FC-318, HFC-32/125, FC-116, and HFC-23 (trifluoromethane).

Further manufacture of Halon 1301 has been banned, because Halon 1301 is considered to be an ozone-depleting chemical. Other, more-readily degradable fire extinguisher fluids are therefore likely to be substituted for Halon 1301 in aircraft fire extinguishers in the future. The method and the apparatus of the embodiments of the intention are applicable to these more degradable aircraft fire extinguisher fluids, including, but not limited to, HFC-23 (trifluoromethane), HFC-125 (pentafluoroethane), trifluoromethane, FC-318, and iodotrifluoromethane.

Although the desiccant may be introduced into the fire extinguisher as a powder or pellets, desiccant powder or pellets can be carried through the orifice of the fire extinguisher by the fire extinguisher fluid and can be ejected from the nozzle of the fire extinguisher into the interior of the aircraft, causing a cleanup problem. Further, the desiccant powder may cause plugging of the orifice.

It is therefore generally preferred that the desiccant be in the form of a solid shape rather than a powder, because the solid shape is less likely to be carried out of the fire extinguisher by the fire extinguisher fluid. The desiccant may be formed into any solid shape which is suitable for introducing into the fire extinguisher. The forming may be done by any suitable method such as pelleting, extruding, casting, or any other suitable method.

The 3A molecular sieve is commercially available as ⅛" diameter pellets from Adcoa. The pellets fracture into small particles when exposed to stress. Although crushing of the molecular sieve pellets does not adversely affect the effectiveness of the molecular sieve in drying the fire extinguisher fluid, it is likely that there will be dust in the fire extinguisher fluid after the pellets are fractured. The dust in the fire extinguisher fluid could plug the orifice on the metering system. The dust could also be carried by the fire extinguisher fluid such as Halon 1301 into the interior of the aircraft when the fire extinguisher is discharged. It is therefore preferable to minimize the crushing of the shaped desiccant.

Figure 1:
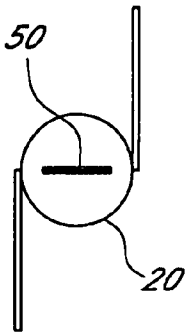
FIG. 1 is an end view of a screen tube assembly for containing desiccant to be placed inside a fire extinguisher bottle.

FIGS. 1 and 2 show a screen tube assembly 10 which is suitable for holding the desiccant inside the fire extinguisher bottle. The screen tube assembly 10 includes a generally cylindrical screen tube 20 preferably made of mesh 40 having a grid size small enough to retain particles of approximately 200 microns or larger. The mesh 40 of the screen tube 20 therefore retains the formed desiccant inside the screen tube 20 but allows the fire extinguisher fluid inside the fire extinguisher to come into contact with the desiccant inside the screen tube 20, so that the desiccant can remove moisture from the fire extinguisher fluid.

Although the mesh 40 is shown on only a portion of the screen tube 20 in FIG. 2, normally the entire screen tube 20 is formed of mesh 40. In alternative embodiments, portions of the screen tube 20 may be solid with no mesh holes. It is generally preferred that at least the majority of the screen tube 20 be formed from mesh 40.

In an exemplary embodiment, the screen tube 20 is made of stainless steel screen, although other materials are suitable for forming the screen tube 20. The diameter of the screen tube 20 is small enough to fit through the outlet hole or the pressure switch hole of the fire extinguisher, so that the screen tube assembly 10 can be placed into the fire extinguisher bottle. The maximum diameter of the screen tube 20 is therefore dependent on the size of the outlet hole or the pressure switch hole. One skilled in the art can choose an appropriate diameter for the screen tube 20 based on the dimensions of the outlet hole and the pressure relief switch of the fire extinguisher.

The ends of the screen tube 20 are preferably closed in order to retain the desiccant inside the screen tube assembly 10. Although the ends of the screen tube 20 may be closed in any manner, for example, by placing caps on the ends of the screen tube 20, in an exemplary embodiment the ends of the screen tube 20 are closed by simply squeezing, pinching, or collapsing the ends of the screen tube 20 and then brazing the ends. Preferably at least one end of the screen tube 20 is collapsed by pressing on opposite sides of the end of the screen tube to form a pinched end 50 and then brazing or welding to hold the closure. FIG. 2 shows the pinched end 50 as viewed along a long axis of the screen tube 20. The pinched end 50 of the screen tube 20 of FIG. 2 has been collapsed into a narrow slit, thereby retaining the desiccant inside the screen tube 20.

In a preferred embodiment, both ends of the screen tube 20 are closed, so that the desiccant is firmly retained inside the screen tube 20 by the two closed ends on the screen tube 20. In an exemplary embodiment, a first end of the screen tube 20 is collapsed into a first pinched end 50. Desiccant is then loaded into the screen tube 20 through a second end of the screen tube 20 until the screen tube 20 contains the desired amount of desiccant. The second end of the screen tube 20 is then collapsed to form a second pinched end 50. The desiccant is firmly retained inside the screen tube 20 by the two pinched ends 50 on the screen tube 20. The pinched ends are brazed or welded to hold them in the pinched condition.

In an alternative embodiment, caps are placed on one or both of the ends of the screen tube 20 to retain the desiccant inside the screen tube. In an exemplary embodiment of the alternative embodiment, a cap is placed on a first end of the screen tube 20, desiccant is loaded into the screen tube 20 though a second end of the screen tube 20 until the screen tube 20 contains the desired amount of desiccant, and then a cap is placed on the second end of the screen tube 20. In another embodiment, a cap is placed on a first end of the screen tube 20 and a second end of the screen tube 20 is crushed and brazed or welded to form a pinched end 50.

The screen tube assembly 10 of FIGS. 1 and 2 includes a plurality of spring wires 30 which are attached to the screen tube 20. Although the spring wires 30 are optional, it is generally preferred that screen wires 30 be included in the screen tube assembly 10. The embodiment of the spring wires 30 shown in FIG. 2 has the form of oval-shaped loops, and the ends of the spring wires 30 of FIG. 2 are attached to the screen tube 20 at or near the ends of the screen tube 20. Spring wires 30 having other shapes may be used in alternative embodiments of the screen tube assembly 10. The spring wires 30 may also be attached to other portions of the screen tube 20 in other embodiments. The embodiment of the screen tube assembly 10 which is shown in FIGS. 1 and 2 is an exemplary embodiment.

Although the screen wires 30 may be attached to the screen tube 20 in any manner including by being soldered or brazed to the screen tube 20, in the embodiment shown in FIG. 2, the ends of the screen wires 30 are woven between the wires on the mesh 40. The screen wires 30 are held in place by welding between the screen wires 30 and the mesh 40.

The spring wires 30 preferably have a diameter small enough so that the spring wires 30 are flexible and can be collapsed. The diameter of the spring wires 30 is preferably large enough to resist crushing of the loops formed by the spring wires 30. If the spring wires 30 are made of stainless steel, the spring wires 30 are preferably approximately 0.040 inches in diameter.

As shown in FIGS. 1 and 2, the two spring wires 30 extend outward from the screen tube 20 from opposite sides of the screen tube 20. One of the purposes of the spring wires 30 is to protect the screen tube 20 from damage. By placing the screen wires 30 on opposite sides of the screen tube 20, both sides of the screen tube 20 are protected. Although the screen wires 30 may be oriented in other manners, the embodiment shown in FIGS. 1 and 2 is an exemplary embodiment.

Referring to FIG. 1, the end view of the screen tube assembly 10, the two screen wires 30 also extend in opposite directions from the screen tube 20 when viewed from the end of the screen tube 20. By orienting the spring wires 30 in this manner, the spring wires 30 provide protection to the screen tube assembly 10 in multiple directions. In other embodiments of the screen tube assembly 10, there are more or fewer screen wires 30 than the two screen wires 30 in the embodiment shown in FIGS. 1 and 2.

Referring to FIG. 2, the oval loops of the spring wires 30 also extend beyond the pinched ends 50 of the screen tube 20. The portions of the spring wires 30 which extend beyond the pinched ends 50 help to keep the screen tube assembly 10 away from the outlet of the fire extinguisher.

The screen tube assembly 10 and the drying agent or desiccant inside the screen tube assembly are inserted into the fire extinguisher by collapsing the spring wires 30, so that the screen tube assembly 10 can fit through one of the holes in the file extinguisher bottle. After the screen tube assembly 10 has been inserted into the fire extinguisher, the spring wires 30 spring back. The expanded spring wires 30 keep the screen tube assembly 10 away from the fire extinguisher outlet, so that the screen tube assembly 10 does not restrict flow of the fire extinguisher fluid to the outlet. In addition to keeping the screen tube assembly 10 away from the outlet of the fire extinguisher, the spring wires 30 also prevent damage to the screen tube assembly 10 from the activation of the explosive cartridge used to activate the fire extinguisher. Finally, the spring wires 30 provide a handle for pulling the screen tube assembly 10 out of the fire extinguisher bottle during refurbishment.

Other forms of flexible projections which keep the screen tube assembly 10 away from the outlet are also suitable for use in the apparatus of the invention. For example, a layer of spongelike foam can be attached to the screen tube assembly 10. Preferably the spongelike foam is closed cell, so that the fire extinguisher fluid is not absorbed by the spongelike foam. The screen tube assembly 10 and attached layer of spongelike foam can be inserted into the fire extinguisher bottle by compressing the foam so that the screen tube assembly 10 and foam are compressed sufficiently so that they can be inserted into the discharge hole of the fire extinguisher. Other embodiments of flexible projections which prevent the screen tube assembly 10 from plugging the outlet will be apparent to one skilled in the art.

Other types of containers besides the screen tube assembly 10 are suitable for holding the drying agent or desiccant inside the fire extinguisher. All that is required is that the container have openings so that the fire extinguisher fluid can flow through the walls of the container to contact the desiccant, that the openings in the container be small enough to retain the desiccant inside the container, and that the container be small enough in diameter to be able to be inserted into the fire extinguisher.

The container need not be made of metal. For example, a cloth bag would be a suitable container, because the cloth has openings which allow the fire extinguisher fluid to flow through the cloth to contact the desiccant inside the cloth bag. Unlike the screen tube assembly 10, however, the cloth bag is flexible, and the flexible cloth bag could cover the outlet hole and be damaged by the explosive cartridge. Further, it is less convenient to attach flexible projections to a cloth bag than to the screen tube assembly 10. A cloth bag is therefore generally a less suitable container for containing the desiccant than the screen tube assembly 10. Other suitable containers will be apparent to one skilled in the art.

The following examples demonstrate some of the advantages of both the method of the invention and of the screen tube assembly 10 according to embodiments of the method and the apparatus of the invention. Molecular sieve 3A was used as the desiccant in all of the examples.

Examples 1 and 2 compare the effects of vibration on a fire extinguisher bottle containing loose desiccant and a fire extinguisher bottle containing desiccant inside a screen tube assembly 10 according to an embodiment of the present invention. Examples 1 and 2 demonstrate that placing the desiccant in the screen tube assembly protects the desiccant from damage when the fire extinguisher is vibrated.

EXAMPLE 1

Vibrating a Fire Extinguisher Bottle Containing Loose Desiccant

A total of 25 grams of ⅛" diameter molecular sieve 3A pellets was placed in a 536 cubic inch fire extinguisher bottle, and 20 pounds of Halon 1301 were added to the fire extinguisher bottle. The bottle was subjected to 5 hours of vibration in each of three axes (15 hours total) at 13.5 GRMS (G Root Mean Square, where G is an acceleration equal to the force of gravity=32.2 pounds/second$^2$). Some of the desiccant was ground up into sandlike particles. The flow test of the fire extinguisher was nominal. A filter upstream of the orifice collected the desiccant, but flow was not restricted.

EXAMPLE 2

Vibrating a Fire Extinguisher Bottle with Desiccant Contained in a Screen Tube Assembly The experiment of Example 1 was repeated, except that the desiccant was placed into a screen tube assembly of the type shown in FIGS. 1 and 2. There was no apparent damage to the desiccant after the vibration. The post flow test of the fire extinguisher was acceptable. The inlet filter of the metering valve was clean.

In another experiment, two screen tube assemblies, each containing 25 g of desiccant, were inserted into an 800 cubic inch fire extinguisher bottle, and the fire extinguisher bottle was vibrated. There was no apparent damage to the desiccant in either screen tube assembly. The flow test of the fire extinguisher was acceptable, and the inlet tube of the metering valve was clean.

In Example 1, the desiccant inside the fire extinguisher was loose, and the desiccant suffered damage when the fire extinguisher was vibrated. The resulting powder could plug the orifice or could be carried into the interior of the aircraft by the Halon 1301 when the fire extinguisher is discharged. While plugging did not occur in the test, it is preferable to contain the desiccant.

In contrast, the desiccant in the two experiments in Example 2 was contained inside screen tube assemblies, and the desiccant was not damaged when the fire extinguishers were vibrated. The comparison demonstrates that the screen tube assembly according to an embodiment of the invention protects the desiccant from damage from vibration of the fire extinguisher bottle.

The following example shows that the desiccant inside the fire extinguisher bottle is effective at removing moisture from the fire extinguisher fluid in the fire extinguisher bottle.

EXAMPLE 3

Removal of Moisture from Halon 1301 Inside a Fire Extinguisher Bottle

A screen tube assembly containing a total of 25 grams of molecular sieve 3A desiccant was placed into a 536 cubic inch fire extinguisher bottle, and the fire extinguisher bottle was charged with approximately 20 pounds of Halon 1301 which was saturated with water. The water content of the Halon 1301 was measured one week later. After one week, the moisture content of the Halon 1301 in the fire extinguisher was approximately 5 ppm, well below the 40 ppm level at which flow freeze-up problems occur.

The results of Example 3 demonstrate that the desiccant was effective at removing moisture from the Halon 1301 in the fire extinguisher to an acceptable level.

The following example shows that the flow rate of the fire extinguisher of Example 3 was acceptable.

EXAMPLE 4

Flow Rate Tests of Fire Extinguishers Containing Wet Halon 1301 After Drying with Desiccant Contained in a Screen Tube Assembly The fire extinguisher of Example 3 was flow tested through a metering system, and the flow was acceptable. The test was repeated on several other fire extinguishers which contained Halon 1301 which had been dried with desiccant in a screen tube assembly in the same manner as in Example 3. All of the fire extinguishers had acceptable flow.

The following example describes experiments on measuring the time rate absorption of the desiccant in dry and humid air.

EXAMPLE 5

Measuring the Time Rate Absorption of Molecular Sieve 3A

Air containing high and low humidity was run through a bed of molecular sieve 3A to measure the length of time required to saturate the molecular sieve. It took about 2 hours to saturate the 3A molecular sieve with high humidity air and about 24 hours to saturate the molecular sieve with low humidity air. The lifetime of the molecular sieve therefore depends on the amount of water in the medium to be dried.

Contacting wet fire extinguisher fluid with desiccant in a fire extinguisher bottle according to embodiments of the method of the present invention therefore prevents freezing at the outlet of the fire extinguisher by removing the moisture from the fire extinguisher fluid. Placing the desiccant into a screen tube assembly in accordance with an embodiment of the apparatus of the present invention protects the desiccant from damage due to discharge and prevents the desiccant from being ejected from the fire extinguisher during discharge.

Various modifications and alterations of this invention will be apparent to those skilled in the art without departing from the scope and spirit of this invention. It should be understood that the invention is not limited to the embodiments disclosed herein, and that the claims should be interpreted as broadly as the prior art allows.

What is claimed is:

1. A method for preventing freezing at an outlet of a fire extinguisher, wherein the fire extinguisher contains fire extinguisher fluid, the method comprising:

disposing a drying agent in a container, wherein the container comprises a plurality of openings sized to confine the drying agent within the container and to permit a fire extinguisher fluid to enter the container;

inserting the container into a fire extinguisher bottle, wherein the container is unattached to the bottle and is removable therefrom;

spacing the container from an outlet of the fire extinguisher bottle, wherein the container does not clog the outlet; and introducing a fire extinguisher fluid into the bottle and into contact with the drying agent, wherein the fire extinguisher fluid in the bottle contacts the drying agent substantially continuously.

2. The method of claim 1, wherein the fire extinguisher fluid comprises a compound selected from the group consisting of halocarbons, halohydrocarbons, and combinations thereof.

3. The method of claim 2, wherein the fire extinguisher fluid comprises bromotrifluoromethane.

4. The method of claim 2, wherein the fire extinguisher fluid comprises a compound selected from the group consisting of bromotrifluoromethane, iodotrifluoromethane, chlorotetrafluoroethane, HCFC-22, 1,1,1,3,3,3-hexafluoropropane, HFC-227, FC-218, FC-3110, HFC-134a, pentafluoroethane, FC-318, HFC-32/125, FC-116, and trifluoromethane.

5. The method of claim 1, wherein the drying agent comprises a zeolite.

6. The method of claim 4, wherein the zeolite is molecular sieve 3A.

7. The method of claim 4, wherein the zeolite is molecular sieve 4A.

8. The method of claim 1, wherein the fire extinguisher fluid is contacted with the drying agent for a period of at least 2 days.

9. The method of claim 1, wherein the fire extinguisher fluid contains less than 40 ppm of water after the contacting.

10. The method of claim 1, wherein the drying agent is in the form of a shaped solid.

11. The method of claim 10, wherein the drying agent is in the form of pellets.

12. An apparatus for preventing freezing at an outlet of a fire extinguisher, said apparatus comprising:

a fire extinguisher bottle; and a container in the bottle having walls with a plurality of openings therein sized to confine a drying agent in the container but to permit fire extinguisher fluid to enter through the openings into the container, said container being open to the interior of the bottle so that as soon as fire extinguisher fluid is introduced into the bottle, the fluid comes into contact with the drying agent and contacts the drying agent substantially continuously.

13. The apparatus of claim 12, wherein said removable container is generally tubular shaped.

14. The apparatus of claim 12, wherein said removable container is made, at least in part, of mesh.

15. The apparatus of claim 14, wherein the mesh is made of metal.

16. The apparatus of claim 15, wherein the mesh is made of stainless steel.

17. The apparatus of claim 12, including at least one flexible projection on the exterior of said container to space the container from the outlet.

18. The apparatus of claim 12, wherein said removable container is removable from said fire extinguisher bottle through an outlet of said fire extinguisher bottle.

19. The apparatus of claim 12, wherein said drying agent is a molecular sieve.

20. The apparatus of claim 19, wherein said molecular sieve is 3A or 4A molecular sieve.

* * * * *